US006229499B1

(12) United States Patent
Licul et al.

(10) Patent No.: US 6,229,499 B1
(45) Date of Patent: May 8, 2001

(54) FOLDED HELIX ANTENNA DESIGN

(75) Inventors: Stanislav Licul, Blacksburg, VA (US); Argyrios A. Chatzipetros, Lake Worth, FL (US)

(73) Assignee: XM Satellite Radio, Inc., Washington, DC (US)

( * ) Notice: Subject to any disclaimer, the term of this patent is extended or adjusted under 35 U.S.C. 154(b) by 0 days.

(21) Appl. No.: 09/434,236

(22) Filed: Nov. 5, 1999

(51) Int. Cl.[7] ..... H01Q 1/36
(52) U.S. Cl. ..... 343/895
(58) Field of Search ..... 343/895, 853

(56) References Cited

U.S. PATENT DOCUMENTS

| | | | | |
|---|---|---|---|---|
| 4,114,164 | * | 9/1978 | Greiser | 343/895 |
| 4,349,824 | | 9/1982 | Harris . | |
| 5,134,422 | | 7/1992 | Auriol . | |
| 5,170,176 | | 12/1992 | Yasunaga et al. . | |
| 5,198,831 | | 3/1993 | Burrell et al. . | |
| 5,255,005 | | 10/1993 | Terret et al. . | |
| 5,349,365 | | 9/1994 | Ow et al. . | |
| 5,541,617 | | 7/1996 | Connolly et al. . | |
| 5,986,620 | * | 11/1999 | Filipovic | 343/895 |

FOREIGN PATENT DOCUMENTS 0 320 404 6/1989 (EP) .

OTHER PUBLICATIONS

"A Shape–Beam Antenna For Satellite Data Communication" published Oct. 12, 1976, by Randolph W. Bricker, Jr. AP–S Session 4, 1630, at the AP–S. International Symposium held in 1976 in Amherst, MA, U.S.A., pp. 121–126.

Antenna Engineering Handbook by Richard C. Johnson and Henry Jasik, pp. 13–19 through 13–21 (1984).

* cited by examiner

*Primary Examiner*—Tan Ho
(74) *Attorney, Agent, or Firm*—William J. Benman

(57) ABSTRACT

A folded helical antenna. Generally, the inventive antenna includes plural radiating elements of conductive material. In the preferred embodiment, the antenna is a quadrifilar helix antenna having four radiating elements. Each radiating element is constrained into a helical shape. In accordance with the present teachings, each radiating element extends in a first direction and has a portion thereof folded in a second direction, the second direction being substantially parallel to the first direction. The novel method of making a quadrifilar helix antenna of the invention includes the steps of: ascertaining desired antenna characteristics for a given application; ascertaining limitations on antenna height for the application; fabricating a helical antenna in accordance with the desired antenna characteristics; and adjusting the height of the antenna in accordance with the limitations by folding the radiating elements thereof.

9 Claims, 4 Drawing Sheets

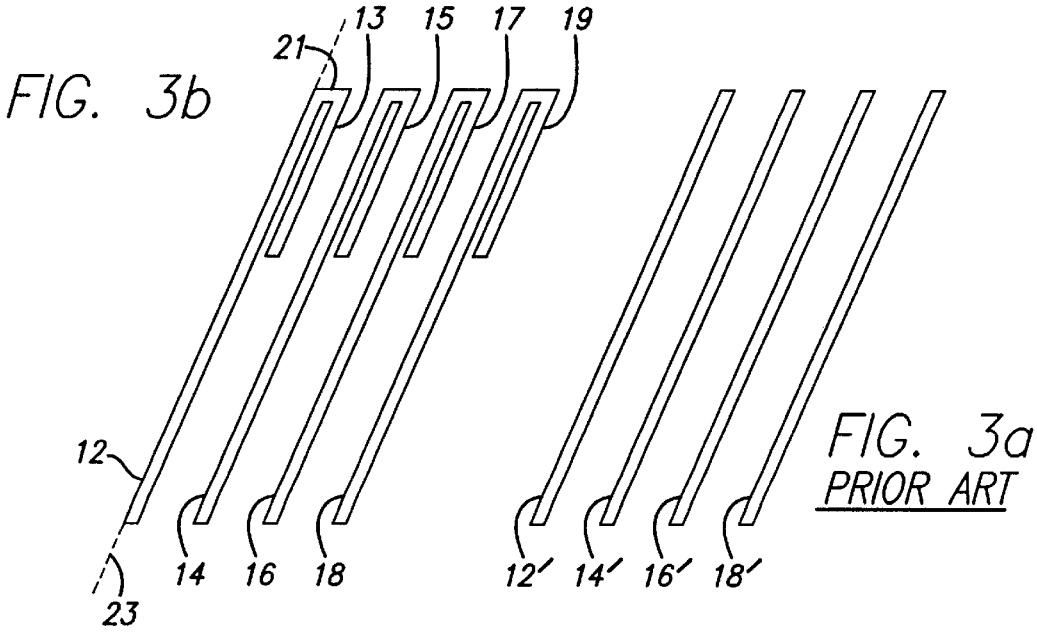
FIG. 3b
FIG. 3a
PRIOR ART
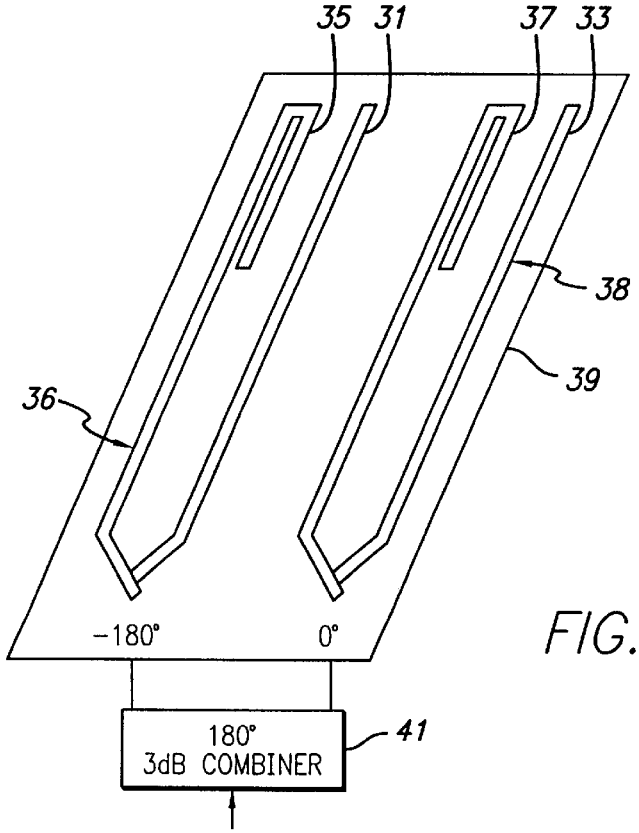
FIG. 7

FIG. 5
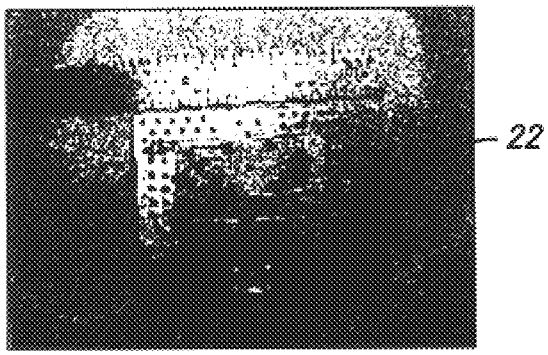
FIG. 4
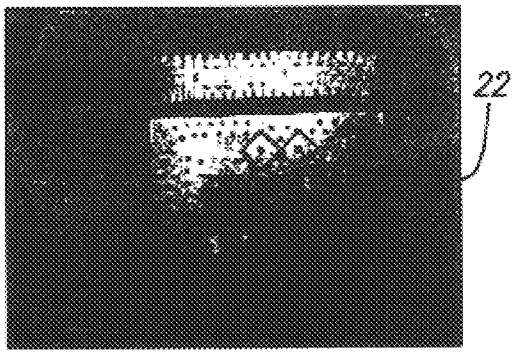
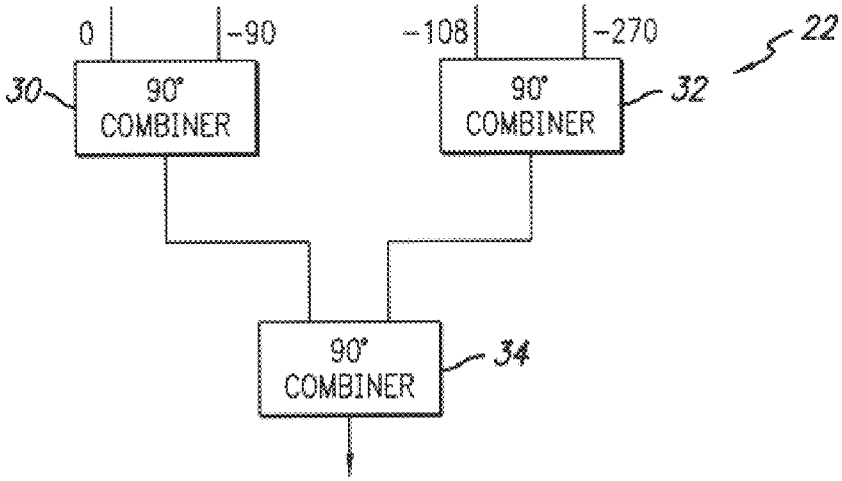
FIG. 6

MEASUREMENTS

| EL. ANGLE (DEG) | FOLDED QFILAR LEFT dBIC | FOLDED QFILAR RIGHT dBIC | PLAIN QFILAR LEFT dBIC | PLAIN QFILAR RIGHT dBIC | IMPROVEMENT LEFT | IMPROVEMENT RIGHT |
|---|---|---|---|---|---|---|
| 20 | 1.6 | 1.5 | 1.3 | 1.4 | .3 | .1 |
| 25 | 2.0 | 1.9 | 1.6 | 1.6 | .4 | .3 |
| 30 | 2.2 | 2.1 | 1.8 | 1.7 | .4 | .4 |
| 35 | 2.4 | 2.2 | 1.9 | 1.7 | .5 | .5 |
| 40 | 2.5 | 2.2 | 1.8 | 1.6 | .7 | .6 |
| 45 | 2.5 | 2.2 | 1.7 | 1.5 | .8 | .7 |
| 50 | 2.3 | 2.0 | 1.5 | 1.3 | .8 | .7 |
| 55 | 2.2 | 1.9 | 1.3 | 1.1 | .9 | .8 |
| 60 | 1.9 | 1.7 | 1.0 | 0.8 | .9 | .9 |

FOLDED HELIX ANTENNA DESIGN

BACKGROUND OF THE INVENTION

1. Field of Invention

This invention relates to antennas. Specifically, the present invention relates to helical antennas.

2. Description of the Related Art

Helical antennas are well known in the art. See for example U.S. Pat. No. 5,541,617 issued Jul. 30, 1996, to Connolly et al.; U.S. Pat. No. 5,349,365 issued Sep. 20, 1994 to Ow et al.; U.S. Pat. No. 5,134,422 issued Jul. 28, 1992 to Auriol; U.S. Pat. No. 4,349,824 issued Sep. 14, 1982 to Harris; U.S. Pat. No. 5,255,005 issued Oct. 19, 1993 to Terret et al.; U.S. Pat. No. 5,170,176 issued Dec. 8, 1992 to Yasunaga et al.; and U.S. Pat. No. 5,198,831 issued Mar. 30, 1993 to Burrell et al., the teachings of which are hereby incorporated herein by reference. See also "A Shape-Beam Antenna For Satellite Data Communication" published Oct. 12, 1976, by Randolph W. Bricker, Jr. AP-S Session 4, 1630, at the AP-S. International Symposium held in 1976 in Amherst, Mass., U.S.A., pp. 121–126.

As noted by Auriol, helical antennas offer the advantage of radiating an electromagnetic wave in a high-quality circular polarization state over a wide coverage area with a transmission lobe which may be shaped as needed for a given application. These characteristics make helical antennas valuable in various fields of use, such as ground links with orbiting satellites or mobile/relay ground links with geosynchronous satellites.

Popular receiving helical antennas are typically either bifilar with two helices spaced equally and circumferentially on a cylinder or quadrifilar with four helices arranged the same way. Because of the radiation or coverage pattern thereof, quadrifilar helix antennas are typically well suited for mobile-to-satellite communication applications. As discussed in Antenna Engineering Handbook by Richard C. Johnson and Henry Jasik, pp. 13–19 through 13–21 (1984), a quadrifilar helix (or volute) antenna is a circularly polarized antenna having four orthogonal fractional-turn (one fourth to one turn) helixes excited in phase quadrature. Each helix is balun-fed at the top with four helical arms of wires or metallic strips of resonant lengths ($l=\lambda/4$, $m=1, 2, 3, \ldots$) wound on a small diameter with a large pitch angle. This antenna is a fairly well suited for various applications requiring a wide hemi-spherical or cardioid shaped radiation pattern. In addition, quadrifilar helix antennas generally offer a high bandwidth as compared to patch antennas over the high frequency ranges required for satellite communication (e.g., GPS) applications.

Recently, a need has been recognized for an antenna suitable for use in mobile satellite radio applications. For the reasons set forth above, the quadrifilar helix antenna is a prime candidate. One of the advantages of the quadrifilar antenna is its compact size and relatively small diameter. For the satellite radio application, the height of the antenna must conform to size and space constraints for a target environment (e.g. automobile installation). Unfortunately, as is well known in the art, the height of a quadrifilar helix antenna is directly related to its impedance. Consequently, any change in the height of the antenna will affect its impedance and its performance. Hence, changes in height of conventional quadrifilar helix antennas typically require a redesign of the impedance matching circuit associated therewith and may affect other components of the system in which it is installed as well.

In addition, changes in the height of conventional quadrifilar helix antennas are limited in that the height of the antenna, that is, the length of the radiating elements, must be a discrete integer multiple of one quarter-wavelength ($\lambda/4$) of the operating frequency of antenna. Further such reductions in the height of conventional quadrifilar helix antennas are achieved, generally, at the cost of reduced gain.

Therefore, for certain applications, a need exists in the art for a system or method for variably adjusting the height of helical antennas, particularly quadrifilar helix antennas, without affecting the performance of same.

SUMMARY OF THE INVENTION

The need in the art is addressed by the folded helical antenna of the present invention. Generally, the inventive antenna includes plural radiating elements of conductive material. In the preferred embodiment, the antenna is a quadrifilar helix antenna having four radiating elements. Each radiating element is constrained into a helical shape. In accordance with the present teachings, each radiating element extends in a first direction and has a portion thereof folded in a second direction, the second direction being substantially parallel to the first direction.

The need the art is also addressed by the novel method of making a quadrifilar helix antenna of the present invention which includes the steps of: ascertaining desired antenna characteristics for a given application; ascertaining limitations on antenna height for the application; fabricating a helical antenna in accordance with the desired antenna characteristics; and adjusting the height of the antenna in accordance with the limitations by folding the radiating elements thereof.

BRIEF DESCRIPTION OF THE DRAWINGS

FIG. 3*a* is a diagram that illustrates the radiating elements of the typical conventional quadrifilar helix antenna of FIG. 1, etched on a thin flexible substrate.

FIG. 3*b* is a diagram which illustrates the radiating elements of the quadrifilar helix antenna of the present invention, etched on a thin flexible substrate.

FIGS. 4 and 5 are top and bottom views, respectively, of a hardware implementation of a feed network used in connection with the illustrative implementation of a quadrifilar helix antenna in accordance with the teachings of the present invention.

FIG. 6 is a block diagram of the feed network used in connection with the illustrative implementation of the quadrifilar helix antenna of the present invention.

FIG. 7 is a diagram of an alternative embodiment of the quadrifilar helix antenna of the present invention, etched on a thin flexible substrate, with an advantageous alternate low cost feed arrangement in accordance with the present teachings.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
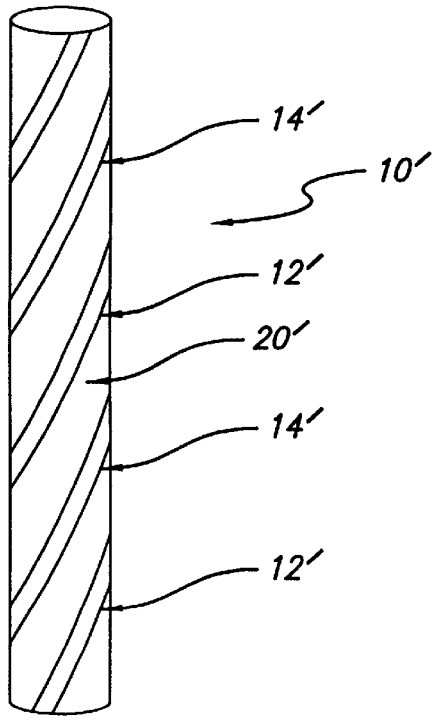
FIG. 1 PRIOR ART
FIG. 1 is a front elevation a view of a typical conventional implementation of a quadrifilar helix antenna in accordance with the teachings of the prior art.

FIG. 1 is a front elevation a view of a typical conventional implementation of a quadrifilar helix antenna in accordance with the teachings of the prior art. As shown in FIG. 1, the antenna 10' includes four radiating elements of which two are shown 12' and 14' mounted on a plastic dielectric tube substrate 20'. The remaining two radiating elements are obscured by the tube. The dielectric tube 20' may be constructed of Ultem or other suitable low loss material e.g., Lexan or urethane.

In the design of a conventional quadrifilar helix antenna, such as that shown in FIG. 1, to achieve a desired radiation pattern in accordance with conventional teachings, one needs to consider three important parameters: pitch, diameter, and height. Each of these parameters can drastically change the radiation properties and impedance of the antenna. Another important parameter is the impedance of the antenna.

Before building the antenna, several simulations are typically performed in order to determine the dimensions appropriate for given application. After the correct diameter, pitch, and height are determined, one is generally ready to build the antenna. There is a potential problem, however. Building the antenna according to. the dimensions provided by simulation does not guarantee a desired impedance, i.e., 50 ohms. To match the antenna to the required impedance, one skilled in conventional teachings would normally clip the antenna elements. Unfortunately, this causes a height reduction, which in turn may yield an undesirable radiation pattern and reduction in gain.

Figure 2:
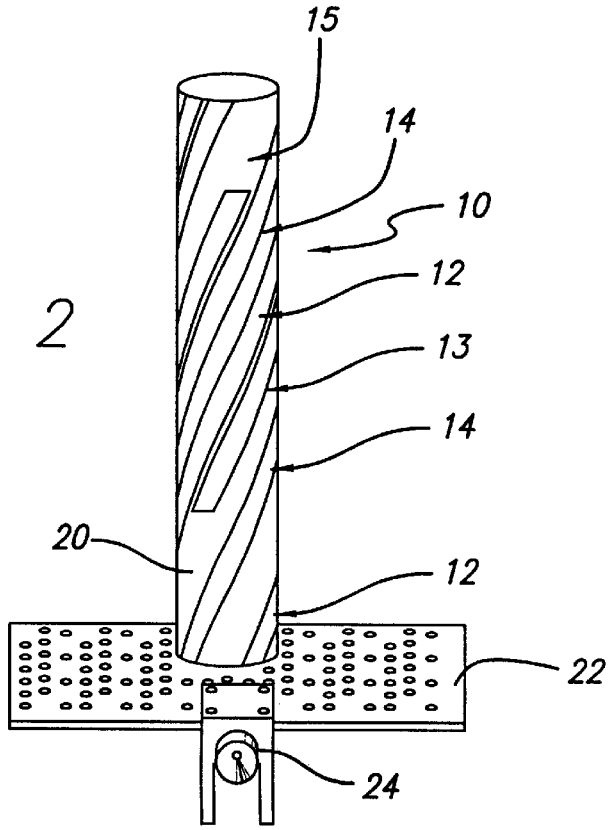
FIG. 2 is a front elevation a view of a quadrifilar helix antenna constructed in accordance with the present teachings.

FIG. 2 is a front elevation a view of a quadrifilar helix antenna constructed in accordance with the present teachings. As shown in FIG. 2, the antenna 10 includes four helical radiating elements of which two are shown 12 and 14 mounted on a feed network 22. The antenna 10 of the present invention is similar to the antenna 10' of FIG. 1 with the exception that, in accordance with the present teachings, each radiating element has some portion thereof which is folded into substantially parallel relation with the longitudinal axis of the radiating element. FIG. 2 shows for example the first radiating element 12 having a portion 13 thereof which is folded in accordance with the teachings of the present invention. Likewise, element 14, has a portion 15 which is folded. The manner of folding the radiating elements is best illustrated and FIGS. 3*a* and 3*b* below.

FIG. 3*a* is a diagram which illustrates the radiating elements of the typical conventional quadrifilar helix antenna 10' of FIG. 1, etched on a thin flexible substrate.

FIG. 3*b* is a diagram which illustrates the radiating elements of the quadrifilar helix antenna 10 of the present invention. 1, etched on a thin flexible substrate. As shown in FIG. 3*b*, each element 12, 14, 16, and 18 of the antenna 10 has a corresponding portion 13, 15, 17, and 19, respectively, which is folded into parallel relation with the corresponding radiating element. Element 12 for example has a portion 13 which is folded into parallel relation with the longitudinal axis 23 thereof. Each folded portion is connected to the main portion of the corresponding radiating element by a short segment 21.

FIGS. 4 and 5 are top and bottom views, respectively, of a hardware implementation of the feed network used in connection with the illustrative implementation of a quadrifilar helix antenna in accordance with the teachings of the present invention. The feed network 22 may be implemented in accordance with conventional teachings.

FIG. 6 is a block diagram of the feed network used in connection with the illustrative implementation of the quadrifilar helix antenna of the present invention. In accordance with conventional teachings, the feed network 22 includes first, second and third 90 degree combiners 30, 32, and 34 respectively. First and second inputs to the first combiner 30 are provided by the first and second radiating elements 12 and 14 of the antenna 10 to the present invention. First and second inputs to the second 90 degree combiner 32 are provided by the third and fourth radiating elements 16 and 18 of the antenna 10 of the present invention. The inputs to the first and second combiners 30 and 32 are combined and provided to the third combiner 34, which, in turn, provides a single output for the antenna 10.

The four helices of a quadrifilar antenna are fed with equal amplitude signals. The relative phases of these signals are: 0°, −90°, −180°, −270°. These amplitude and phase requirements are achieved by the feed network shown in FIGS. 4, 5, and 6.

FIG. 7 is a diagram of an alternative embodiment of the quadrifilar helix antenna of the present invention, etched on a thin flexible substrate 39, with an advantageous alternate low cost feed arrangement. The embodiment of FIG. 7 achieves the same phase relationships between the radiating elements as the embodiment of FIGS. 4, 5, and 6. The quadrifilar antenna depicted in FIG. 7 consists of two pairs of helices 36 and 38. For each pair, the two helices are connected together at the bottom and one element in each pair 35, 37 is folded on top by approximately ¼ wavelength, which is equivalent to a 90-degree phase delay. Thus, each pair of helices 36 and 38 includes one folded element 35 and 37 and one non-folded element 31 and 33, respectively. A 180-degree 3-dB combiner 41 is connected to the two pairs of helices 36 and 38. As a result, the desired phase relationship: 0°, −90°, −180°, −270° for each of the four radiating elements is achieved. The advantage of this method is that only one combiner 41 is required as compared to the three combiners 30, 32 and 34 required in the conventional feed network depicted in FIG. 6. The technique utilized in the embodiment of FIG. 7 makes the feed network simpler, smaller in size and lower in cost.

Those skilled in the art will appreciate that the present invention is not limited to the folding of the first and third radiating elements 35 and 37. Various combinations of the radiating elements 31, 33, 35 and 37 may be folded to achieve phase relationships as may be required for given application. In addition, the invention is not limited to the use of a single combiner in connection with the antenna depicted in FIG. 7. Thus, utilizing the present teachings, one of ordinary skill the art may achieve a variety of phase relationships by folding various combinations of radiating elements and feeding the elements with a variety of combiners connected in various configurations.

The novel method of making a quadrifilar helix antenna of the present invention includes the steps of: ascertaining desired antenna characteristics for a given application; ascertaining limitations on antenna height for the application; fabricating a helical antenna in accordance with the desired antenna characteristics; and adjusting the height of the antenna in accordance with the limitations by folding the radiating elements thereof. The fabrication step might involve the application of conductive (e.g., copper) tape or wire in a spiral fashion to a dielectric tube that is shorter in length than the angled length of the radiating elements. The excess length of each radiating element is then folded into parallel relation in the manner disclosed herein and illustrated in FIG. 3*b* above. In the alternative, the elements may be etched on a substrate which is subsequently wrapped around a dielectric tube.

One advantage of the antenna 10 of the present invention is that antenna height is maintained while impedance matching is achieved by folding the excess wire of each radiating element back onto itself. For example, one may expect to be able to reduce the height of the antenna 10 by 10% to 20%, compared to that of the antenna 10' of FIG. 1, without adversely affecting the gain thereof. Thus, for an antenna operating at an exemplary XM satellite radio frequency of approximately 2.4 GHz, the height of the antenna may be reduced from ½ to 1 inch (from 5 inches down to 4–4.5 inches in total height) without adversely affecting the gain. A practical limit on the extent to which the elements may be folded is expected to be on order of 0.5λ.

Figures 8, 9:
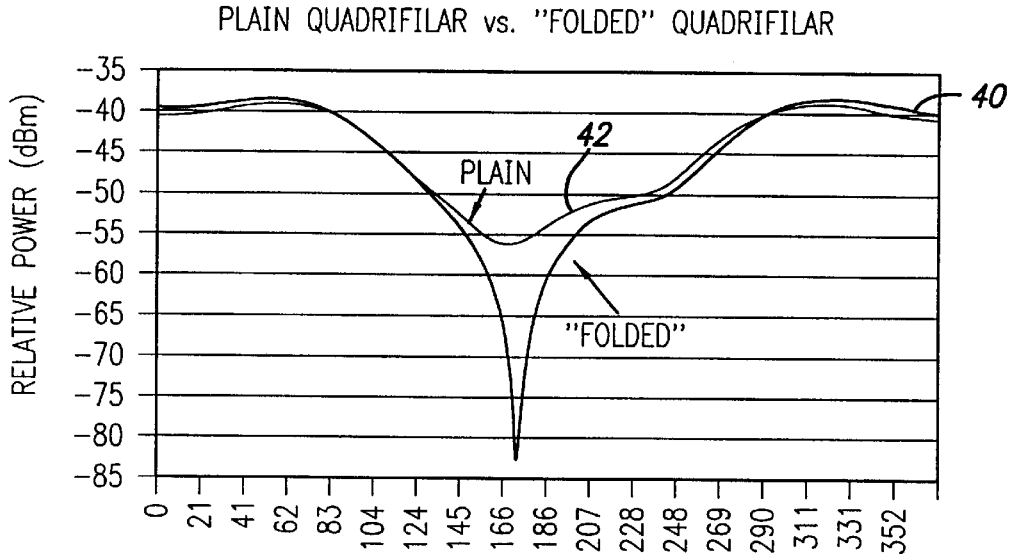
FIG. 8 shows a comparison of radiation patterns generated by a typical conventional quadrifilar helix antenna and a quadrifilar helix antenna implemented in accordance with the teachings of the present invention.
FIG. 9 is a table which shows the gain of the antenna of the present invention as compared to the gain of an antenna constructed in accordance with conventional teachings.

Using this technique, the antenna may be systematically optimized to provide a desired radiation pattern. This is depicted in FIG. 8 which shows a comparison of radiation patterns generated by a typical conventional quadrifilar helix antenna and a quadrifilar helix antenna implemented in accordance with the teachings of the present invention. In FIG. 8, the x-axis represents elevation angle with zero degrees being zenith, directly above the antenna, and 180 degrees being directly below. Those skilled in the art will appreciate that the top to bottom ratio of the antenna is a significant parameter inasmuch as it represents the extent to which radiation from the antenna will interfere with circuitry disposed directly below the antenna. In FIG. 8, the thicker line 40 represents the power output or sensitivity of the antenna 10 of the present invention as a function of elevation angle and the thinner line 42 represents the relative power of the conventional antenna 10' of FIG. 1. As is evident in FIG. 8, the antenna 10 of the present invention provides better top to bottom performance with a slight increase in gain at the elevation angles to which radiation from antenna is desired. This is shown more clearly in FIG. 9.

FIG. 9 is a table which shows the gain of the antenna of the present invention as compared to the gain of an antenna constructed in accordance with conventional teachings. In the table shown in FIG. 9, the first column lists the elevation angles and the next two pairs of columns show the left and right halves of the horizon as radiated by the antenna 10 of the present invention and the conventional antenna 10' of FIG. 1, respectively. Finally, left and right measured gain improvement values are shown in the final pair of columns.

Thus, the present invention has been described herein with reference to a particular embodiment for a particular application. Those having ordinary skill in the art and access to the present teachings will recognize additional modifications, applications and embodiments within the scope thereof. For example, those skilled in the art will appreciate that although the present invention is illustrated with respect to an application by which the antenna 10 is used for reception, the antenna may be used for transmission as well. That is, the performance benefits discussed above with respect to radiation in a transmission mode will be understood as relating to sensitivity when implemented in a receiver. In this case, the above-referenced top to bottom ratio of the antenna of the present invention is effective to minimize the interference in the antenna induced by circuitry disposed below the antenna.

Further, the present invention is not limited to use in satellite radio applications. For example, by simply changing the direction of the line means of the radiating elements, the teachings of the present invention may be utilized for GPS applications. Indeed the teachings of the present invention may be utilized for various applications at various frequencies without departing from the scope thereof.

It should also be noted that the teachings of the present invention are not limited to use in connection with quadrifilar helix antennas. The present teachings may be utilized with helical and spiral antennas having any number of radiating elements.

It is therefore intended by the appended claims to cover any and all such applications, modifications and embodiments within the scope of the present invention.

Accordingly,

What is claimed is:

1. A quadrifilar helix antenna comprising:

first, second, third, and fourth radiating elements of conductive material, each element extending in a first direction and having a portion thereof folded in a second direction, said second direction being substantially parallel to said first direction;

means for individually feeding at least two of said elements; and means for maintaining said radiating elements in a helical or spiral shape.

2. The invention of claim 1 wherein each of said radiating elements has a portion folded into parallel relation with a longitudinal axis of said element.

3. The invention of claim 2 wherein said means for individually feeding at least two of said elements further includes a feed network electrically coupled to said radiating elements.

4. The invention of claim 1 wherein at least two of said radiating elements have a portion at the distal end thereof folded into parallel relation with a longitudinal axis thereof.

5. The invention of claim 4 wherein said two said radiating elements are the first and third radiating elements.

6. The invention of claim 5 wherein said second and fourth radiating elements are not folded at respective distal ends thereof.

7. The invention of claim 6 wherein said first and second radiating elements are connected at proximal ends thereof to provide a first terminal and said third and fourth radiating elements are connected at proximal ends thereof to provide a second terminal.

8. The invention of claim 7 wherein said means for individually feeding at least two of said elements further includes a 180 degree combiner connected to said first and second terminals.

9. A quadrifilar helix antenna comprising:

first, second, third, and fourth radiating elements of conductive material extending, each radiating element having a portion thereof folded in a direction being substantially parallel to a longitudinal axis of said radiating element;

a dielectric tube for maintaining said radiating elements in a helical or spiral shape; and means for coupling electrical energy to and/or from each of said radiating elements; said means for coupling including means for individually feeding at least two of said elements.

* * * * *